US008044607B2

(12) United States Patent
Biebl et al.

(10) Patent No.: US 8,044,607 B2
(45) Date of Patent: Oct. 25, 2011

(54) CIRCUIT UNIT

(75) Inventors: Alois Biebl, St. Johann (DE); Günther Hirschmann, München (DE)

(73) Assignee: OSRAM AG, Munich (DE)

( * ) Notice: Subject to any disclaimer, the term of this patent is extended or adjusted under 35 U.S.C. 154(b) by 385 days.

(21) Appl. No.: 12/227,269

(22) PCT Filed: Jun. 5, 2007

(86) PCT No.: PCT/EP2007/055497

§ 371 (c)(1),
(2), (4) Date: Nov. 12, 2008

(87) PCT Pub. No.: WO2007/141254

PCT Pub. Date: Dec. 13, 2007

(65) Prior Publication Data

US 2009/0128050 A1 May 21, 2009

(30) Foreign Application Priority Data

Jun. 9, 2006 (DE) ..... 10 2006 026 938

(51) Int. Cl.
*H05B 37/02* (2006.01)

(52) U.S. Cl. ..... 315/291; 315/297

(58) Field of Classification Search ..... 315/291, 315/294–297, 312, 313
See application file for complete search history.

(56) References Cited

U.S. PATENT DOCUMENTS

| | | | | |
|---|---|---|---|---|
| 6,683,419 | B2 | 1/2004 | Kriparos et al. | |
| 6,690,146 | B2 | 2/2004 | Burgyan et al. | |
| 6,791,283 | B2 * | 9/2004 | Bowman et al. | 315/291 |
| 7,116,086 | B2 | 10/2006 | Burgyan et al. | |
| 2003/0076051 | A1 | 4/2003 | Bowman et al. | |
| 2003/0234621 | A1 | 12/2003 | Kriparos et al. | |
| 2003/0235062 | A1 | 12/2003 | Burgyan et al. | |
| 2005/0007770 | A1 | 1/2005 | Bowman et al. | |
| 2007/0205725 | A1 | 9/2007 | Bastians et al. | |

FOREIGN PATENT DOCUMENTS

| | | | |
|---|---|---|---|
| JP | 2005011895 | A | 1/2005 |
| WO | WO 2004/057924 | A1 | 7/2004 |
| WO | WO 2005/039251 | A1 | 4/2005 |

OTHER PUBLICATIONS

"LT1615 Micropower Step-up DC/DC Converters in ThinSOT", 1998, Linear Technology Corp., Milpitas, CA, USA, XP002451184.

Dave Kim: "Design Note 231, Tiny Regulators Drive White LED Backlights" 2000, Linear Technology Corp., Milpitas, CA, USA, XP002451185.

* cited by examiner

*Primary Examiner* — Don Le

(74) *Attorney, Agent, or Firm* — Holtz, Holtz, Goodman & Chick, PC

(57) ABSTRACT

The invention relates to a circuit unit for a semiconductor unit which produces radiation, with a forward voltage $U_f$ being applied during operation to the semiconductor unit which produces radiation, and with a forward current $I_f$ flowing through the semiconductor unit which produces radiation, with the circuit unit regulating the forward current $I_f$ such that an actual value $V_{act}$ which depends on the forward current $I_f$ and the forward voltage $U_f$ assumes a predetermined nominal value $V_{nom}$. The invention also relates to a radiation source.

31 Claims, 7 Drawing Sheets

CIRCUIT UNIT

Figure 1:
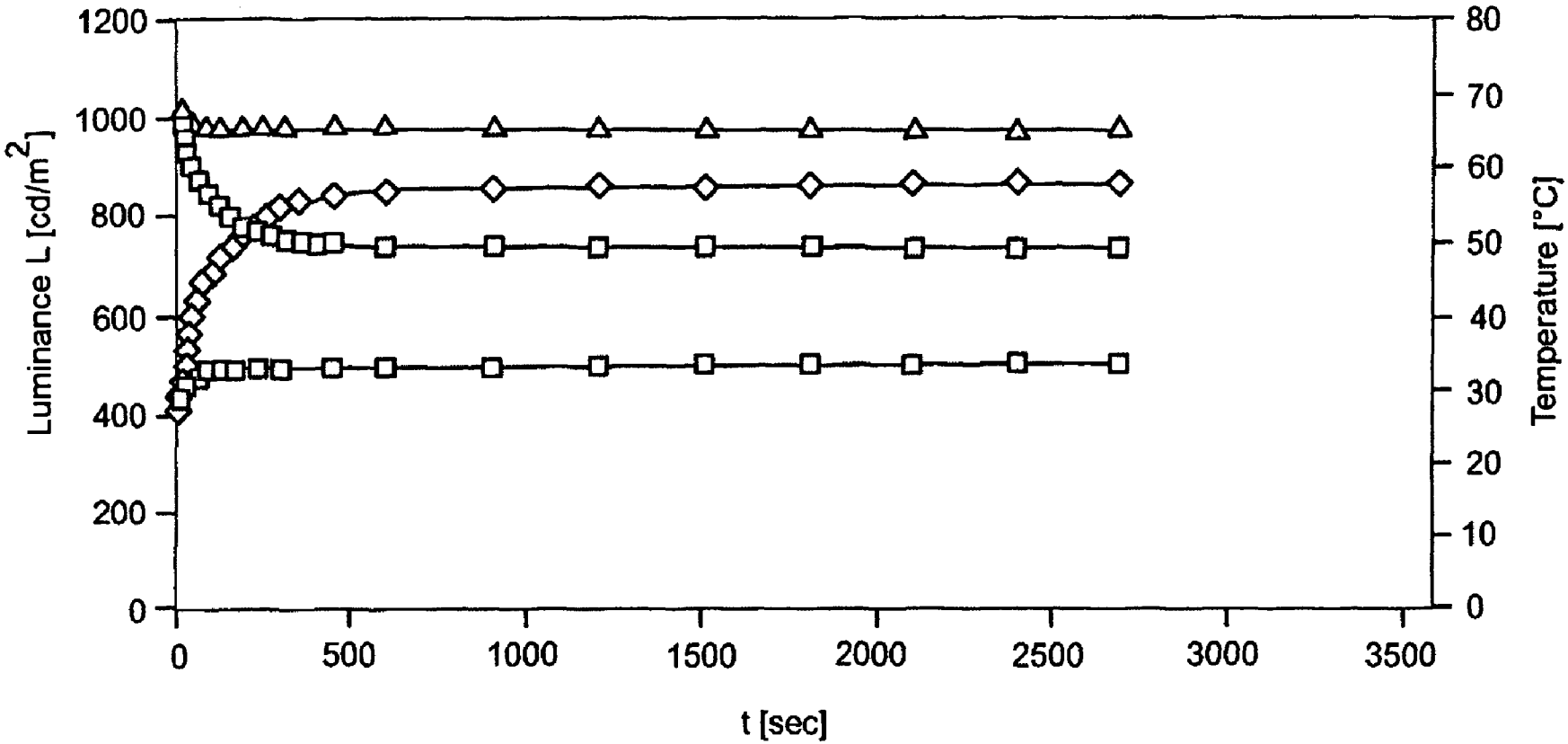

This application is a U.S. National Phase Application under 35 USC 371 of International Application PCT/EP2007/055497, filed Jun. 5, 2007, which is incorporated herein in its entirety by this reference.

The invention relates to a circuit unit for a radiation-producing semiconductor unit.

In a conventional radiation-producing semiconductor unit, for example a light-emitting diode, a forward current $I_f$ flowing through the semiconductor unit is kept at a constant level by means of constant current regulation. In this case, the problem may arise that the intensity of the radiation produced by the semiconductor unit decreases as said semiconductor unit heats up.

The abstract JP 2005-011895 A discloses an LED circuit which allows a constant current through a white LED.

It is an object of the present invention to specify a circuit unit which allows simple luminous flux regulation in a radiation-producing semiconductor unit.

This object is achieved by a circuit unit in accordance with patent claim 1.

It is also an object of the present invention to specify a radiation source with simple luminous flux regulation.

This object is achieved by a radiation source in accordance with patent claim 16.

In the case of an inventive circuit unit for a radiation-producing semiconductor unit, during operation a forward voltage $U_f$ is applied to the radiation-producing semiconductor unit and the radiation-producing semiconductor unit has a forward current $I_f$ flowing through it, wherein the circuit unit regulates the forward current $I_f$ such that an actual value $V_{act}$, which is dependent on the forward current $I_f$ and the forward voltage $U_f$, assumes a prescribed setpoint value $V_{set}$.

In this case, not only the exact correspondence $V_{act}=V_{set}$ means that the actual value $V_{act}$ assumes the prescribed setpoint value $V_{set}$. Rather, the invention tolerates the setpoint value $V_{set}$ being kept within a prescribed variation, which may typically be up to 10% of the actual value $V_{act}$.

The inventive circuit unit is used to perform luminous flux regulation, preferably power regulation. Assuming that the intensity of the radiation produced by the semiconductor unit, or the luminous flux, is proportional to the electrical power which is converted in the radiation-producing semiconductor unit, luminous flux regulation has the advantage over constant current regulation that smaller fluctuations in the luminous flux occur. Since the forward voltage $U_f$ decreases as the radiation-producing semiconductor unit becomes increasingly hot, the converted electrical power and hence the radiation intensity decreases in the case of conventional constant current regulation. In line with the invention, on the other hand, the forward current $I_f$ is varied on the basis of the forward voltage $U_f$ such that the electrical power and hence the radiation power remain at a constant level. Variations within the tolerance range indicated above are permissible.

In line with one preferred embodiment, the circuit unit has an actuation unit and an evaluation unit. The actuation unit can be used to control the forward current $I_f$ flowing through the radiation-producing semiconductor unit. The evaluation unit can be used to determine an instantaneous value for the forward current. In addition, the evaluation unit can be used to determine an instantaneous actual value $V_{act}$.

In line with a further preferred embodiment of the circuit unit, the evaluation unit comprises a nonreactive resistor. Preferably, a voltage drop across the nonreactive resistor is used to ascertain the forward current $I_f$. This allows simple determination of the forward current $I_f$. In contrast to conventional apparatuses, the invention allows additional components such as a photodiode or a temperature sensor to be dispensed with for determining the forward current $I_f$, which is influential for the radiation intensity of the radiation source. In the case of a photodiode, the light emitted by the radiation-producing unit is sensed by the photodiode and the instantaneous actual value of the photoelectric current produced is compared with the prescribed setpoint value. In the case of a temperature sensor, a temperature-dependent resistor can be used to ascertain the temperature of the radiation-producing unit and to customize the forward current $I_f$ accordingly. In the case of the invention, on the other hand, a nonreactive resistor is sufficient to determine the instantaneous actual value of the forward current $I_f$.

Particularly preferably, the nonreactive resistor is connected in series with the radiation-producing semiconductor unit. In particular the nonreactive resistor is connected downstream of the radiation-producing semiconductor unit in the forward direction thereof.

In line with one preferred variant, the evaluation unit comprises a mathematical circuit. The mathematical circuit can be used to perform mathematical operations on the input variables, that is to say the forward voltage $U_f$ and the forward current $I_f$, such as multiplication, division, addition and subtraction.

In line with a further preferred variant, the actual value $V_{act}$ can be determined using the mathematical circuit. The actual value $V_{act}$ is particularly a function f of the forward voltage $U_f$ and the forward current $I_f$, wherein one of the following correlations applies: $V_{act}=f(U_f*I_f)$; $V_{act}=f(U_f/I_f)$; $V_{act}=f(U_f+I_f)$; $V_{act}=f(U_f-I_f)$. In contrast to the conventional constant current regulation, it is therefore not only the forward current $I_f$ which is of interest but also the forward voltage $U_f$. Preferably, the function f is dependent exclusively on the forward voltage $U_f$ and the forward current $I_f$.

The forward current $I_f$ may be a direct current or a clocked current, with pulse-width modulation (PWM) preferred in the latter case. The radiation intensity of the semiconductor bodies can be altered by varying the direct current or altering the duty cycle (ratio of pulse duration to period duration of the PWM actuation. Advantageously, the eye perceives an average radiation intensity at different duty cycles.

To determine the actual value $V_{act}$ for a clocked current as indicated, the average forward current $I_f$ needs to be ascertained. For this, the evaluation unit may have an averaging element. Expediently, the averaging element matches the duty cycle. By way of example, the averaging element may be an RC low-pass filter.

Advantageously, the evaluation unit has at least one element for determining the difference between $V_{act}$ and $V_{set}$. It is thus possible to ascertain how greatly $V_{act}$ differs from $V_{set}$. Preferably, the element is a subtractor which is used as a regulator. The ascertained difference forms the basis for regulating the forward voltage $U_f$ and the forward current $I_f$.

Expediently, the actuation unit is electrically conductively connected to the evaluation unit. Advantageously, this allows the output voltage, which is applied to the semiconductor unit and is equal to the forward voltage $U_f$, and the forward current $I_f$ to be regulated on the basis of the ascertained actual value $V_{act}$.

Preferably, the actuation unit comprises a voltage converter. The voltage converter may be a DC/DC converter, particularly a SEPIC (Single Ended Primary Inductance Converter) converter, for example. Particularly preferably, the voltage converter can be used to customize a supply voltage provided for the radiation source such that the output voltage applied to the semiconductor unit assumes a desired value.

A radiation source according to the invention has a circuit unit as described above.

Advantageously, this allows the radiation source to be operated at a relatively constant luminous flux, which means that variations within the tolerance range indicated above are admissible.

In line with one preferred embodiment, the radiation source also comprises a radiation-producing semiconductor unit, wherein the producing-producing unit is electrically conductively connected to the circuit unit. For example, the radiation-producing semiconductor unit and the circuit unit may be arranged on a common printed circuit board and electrically conductively connected by means of conductor tracks.

The circuit unit can be used to regulate the forward voltage $U_f$ and the forward current $I_f$ of the radiation-producing unit. In addition, this allows the luminous flux to be regulated.

In line with a further preferred embodiment, the radiation-producing unit has at least one radiation-producing semiconductor body.

In addition, the radiation-producing unit may have a series circuit comprising a plurality of semiconductor bodies. This allows the same level of current to be attained by all semiconductor bodies, which means that a uniform brightness can be achieved over an illuminated area.

Particularly for applications in the automotive sector or for illumination purposes, a plurality of semiconductor bodies affords the further advantage of higher radiation intensity. A compact arrangement of the semiconductor bodies can also be used to achieve a comparatively high luminance.

Preferred refinements of a radiation-producing semiconductor unit for which the circuit unit based on the invention is suitable can be found in laid-open specification WO 2006/012842 A2, the content of which is hereby included by reference.

The individual semiconductor body may contain a material "based on nitride compound semiconductors", which in the present context means that the semiconductor body for producing radiation has a layer sequence or at least one layer which comprises a nitride III/V compound semiconductor material, preferably $Al_nGa_mIn_{1-n-m}N$, where $0 \leqq n \leqq 1$, $0 \leqq m \leqq 1$ and $n+m \leqq 1$. In this case, this material does not necessarily have to have a mathematically exact composition based on the above formula. Rather, it may have one or more dopants and additional constituents which essentially do not change the characteristic physical properties of the $Al_nGa_mIn_{1n-m}N$ material. For the sake of simplicity, the above formula contains only the essential constituents of the crystal lattice (Al, Ga, In, N), however, even if these may in part be replaced by small quantities of further substances.

The active or radiation-producing layer of the semiconductor body may be in the form of a heterostructure, dual heterostructure or in the form of a quantum-well structure, for example. In this case, the term quantum-well structure covers any structure in which charge carriers undergo quantization of their energy states through confinement. In particular, the term quantum-well structure does not hold any indication of the dimensionality of the quantization. It therefore covers quantum wells, quantum wires and quantum dots and any combination of these structures, inter alia.

The semiconductor body may be in the form of thin-film light-emitting diode chips.

A thin-film light-emitting diode chip is distinguished particularly by at least one of the following characteristic features:

a first main face, facing a support element, of a radiation-producing epitaxial layer sequence has a reflective layer put or formed on it which reflects back at least a portion of the electromagnetic radiation produced in the epitaxial layer sequence into said sequence;

the epitaxial layer sequence has a thickness in the region of 20 μm or less, particularly in the region of 10 μm; and the epitaxial layer sequence contains at least one semiconductor layer having at least one face which has a mixing structure which, ideally, results in an approximately ergodic distribution of the light in the epitaxial layer sequence, i.e. it has the most ergodically stochastic scattering behavior possible.

A fundamental principle of a thin-layer light-emitting diode chip is described by way of example in I. Schnitzer et al., Appl. Phys. Lett. 63 (16), 18 Oct. 1993, 2174-2176, the disclosure content of which is hereby included to this extent by reference.

A thin-film light-emitting diode chip is, to a good approximation, a Lambert surface emitter and is thus particularly highly suitable for use in a headlight.

In particular, the radiation-producing unit may contain at least one light-emitting diode or laser diode. By way of example, the radiation-producing unit may be an array formed from a plurality of light-emitting diodes or laser diodes. The spectral intensity maximum of the light-emitting diode or of the laser diode may be in the ultraviolet range, in the visible range or the infrared range of the electromagnetic spectrum.

In line with one preferred variant, the radiation source is provided for a headlight.

In addition, the inventive radiation source may be provided for the purpose of illumination. Advantageously, the radiation source is suitable for illumination at constant luminance.

In addition, the radiation source may be provided for backlighting, for example of a display.

Further preferred features, advantageous refinements and developments and also advantages of a multiple quantum-well structure and of a radiation-emitting semiconductor body or component based on the invention can be found in the exemplary embodiments which are explained in more detail below in conjunction with FIGS. 1 to 7.

In which

Figure 2:
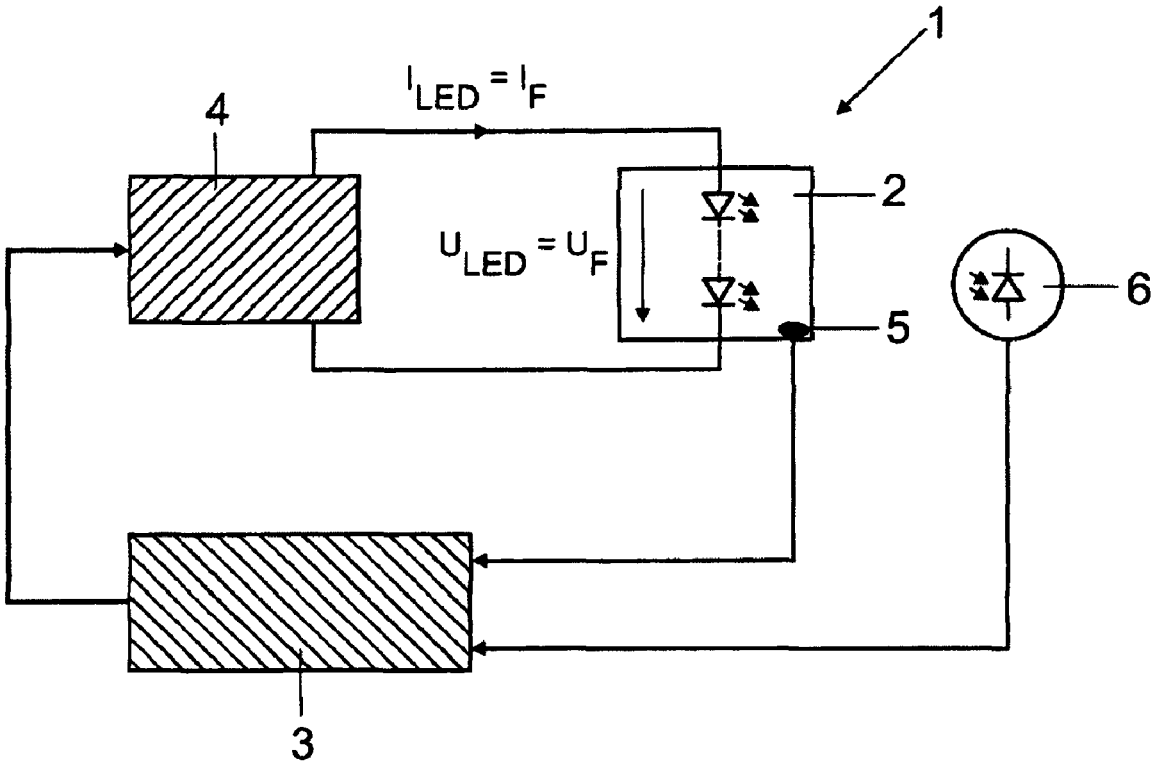
Figure 3A:
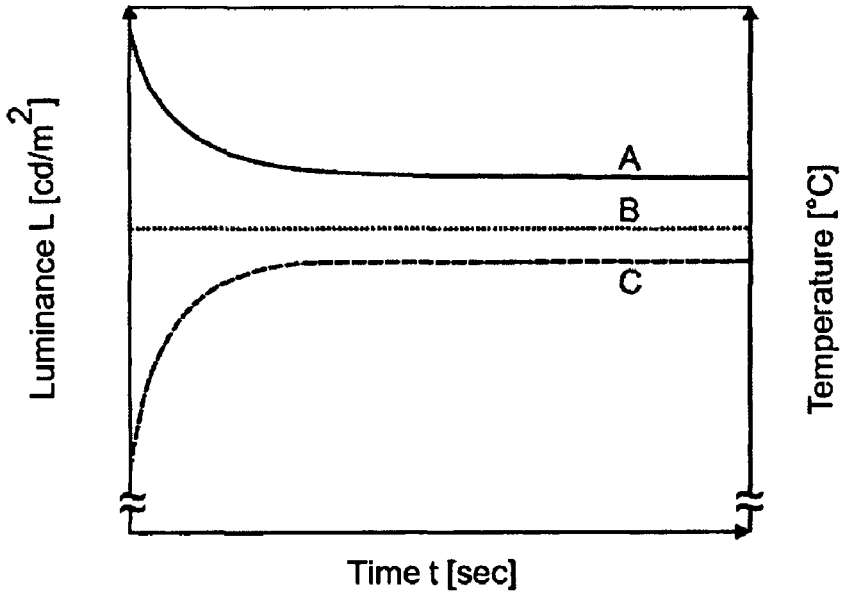
Figure 3B:
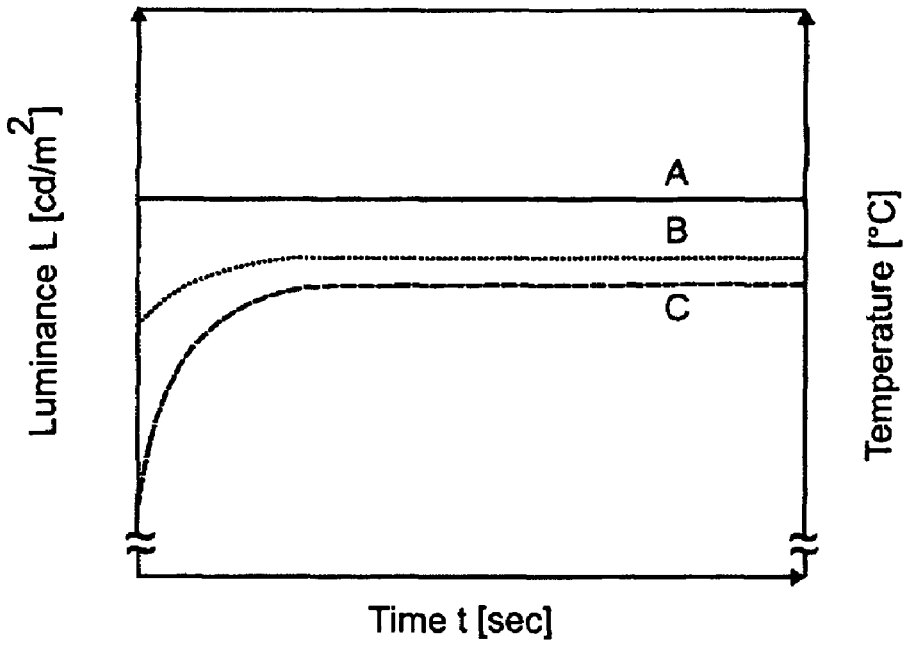
Figure 4:
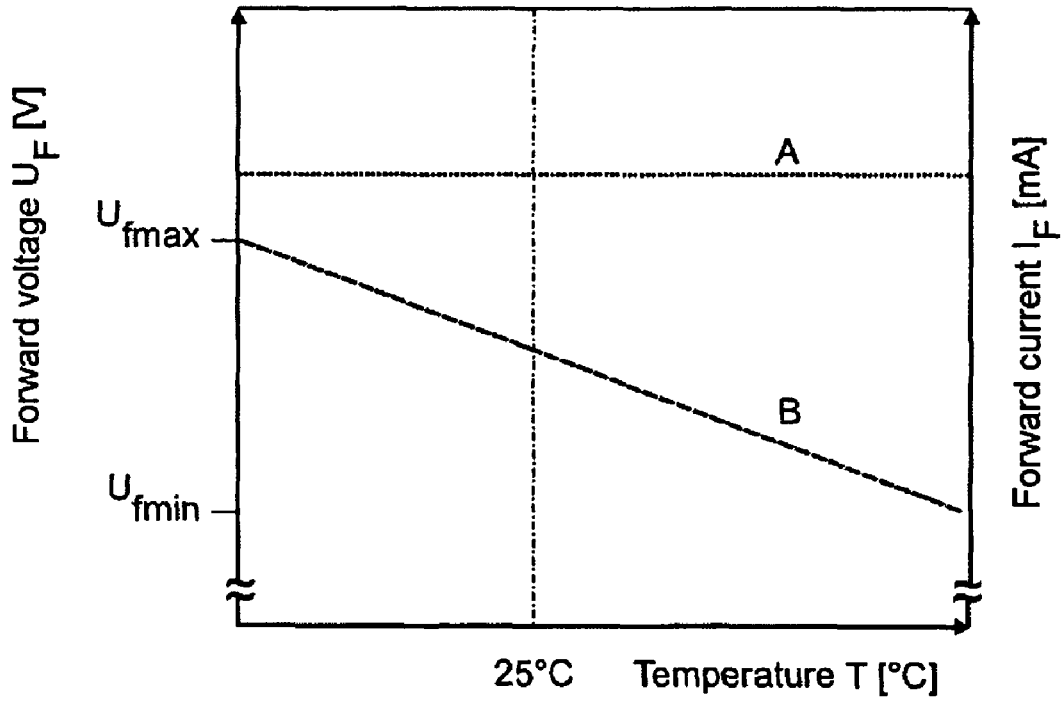
Figure 5A:
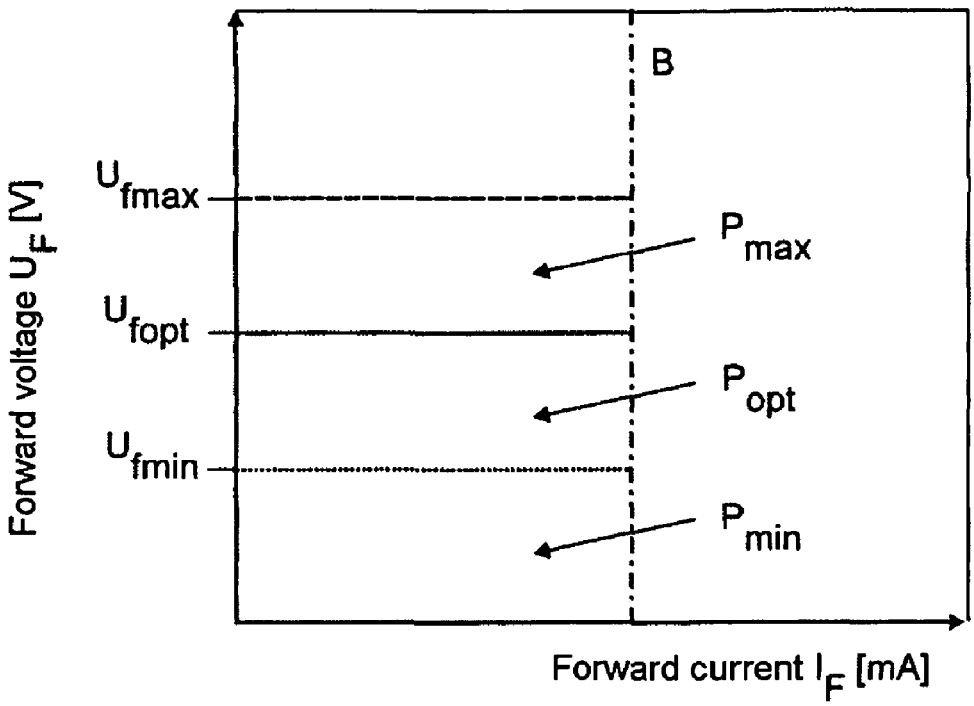
Figure 5B:
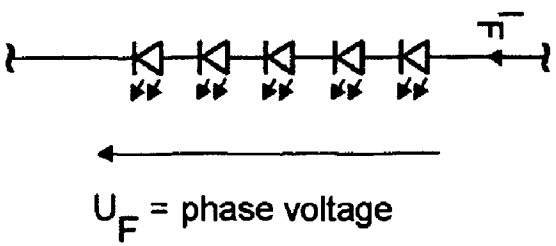
Figure 6:
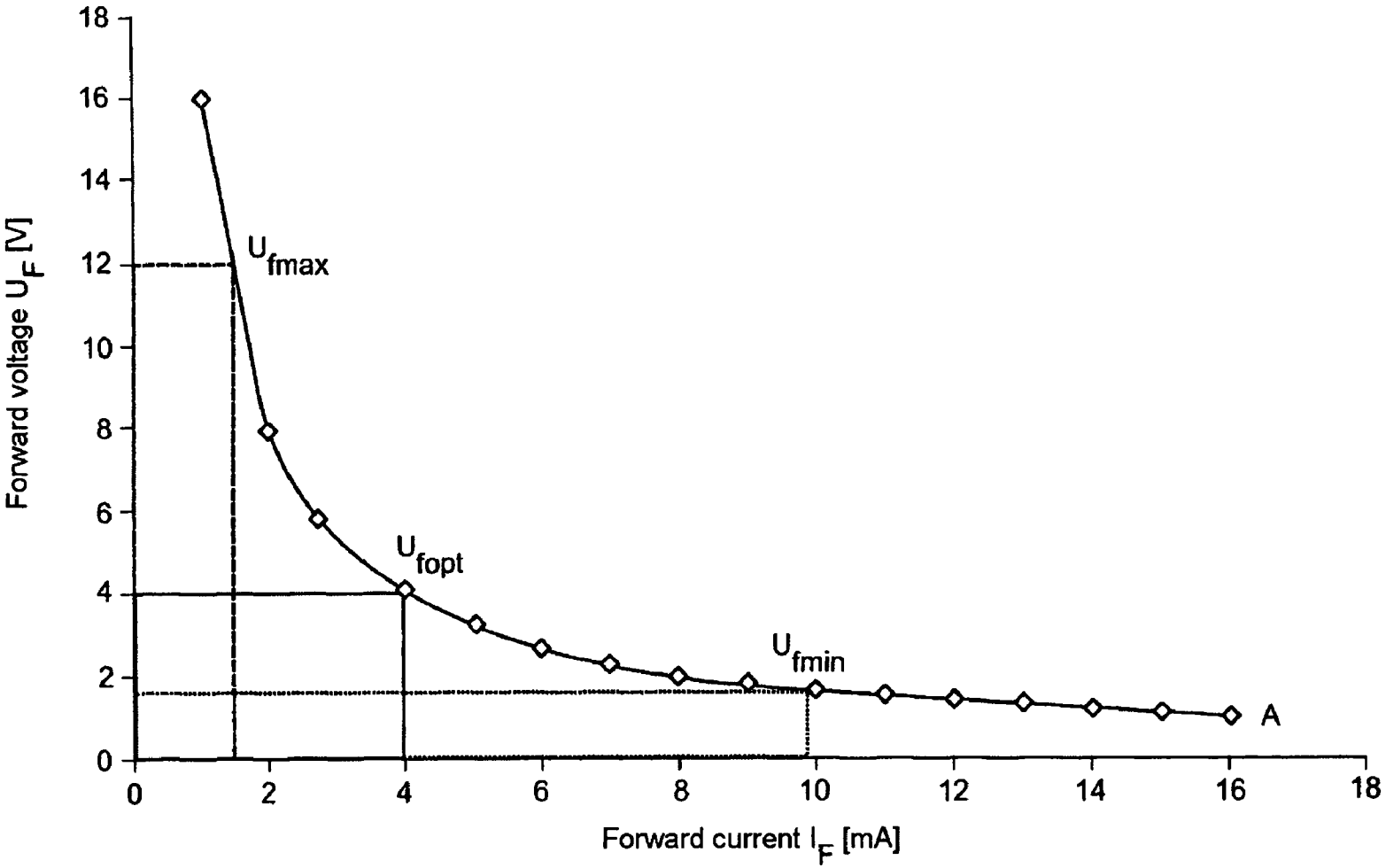
Figure 7:
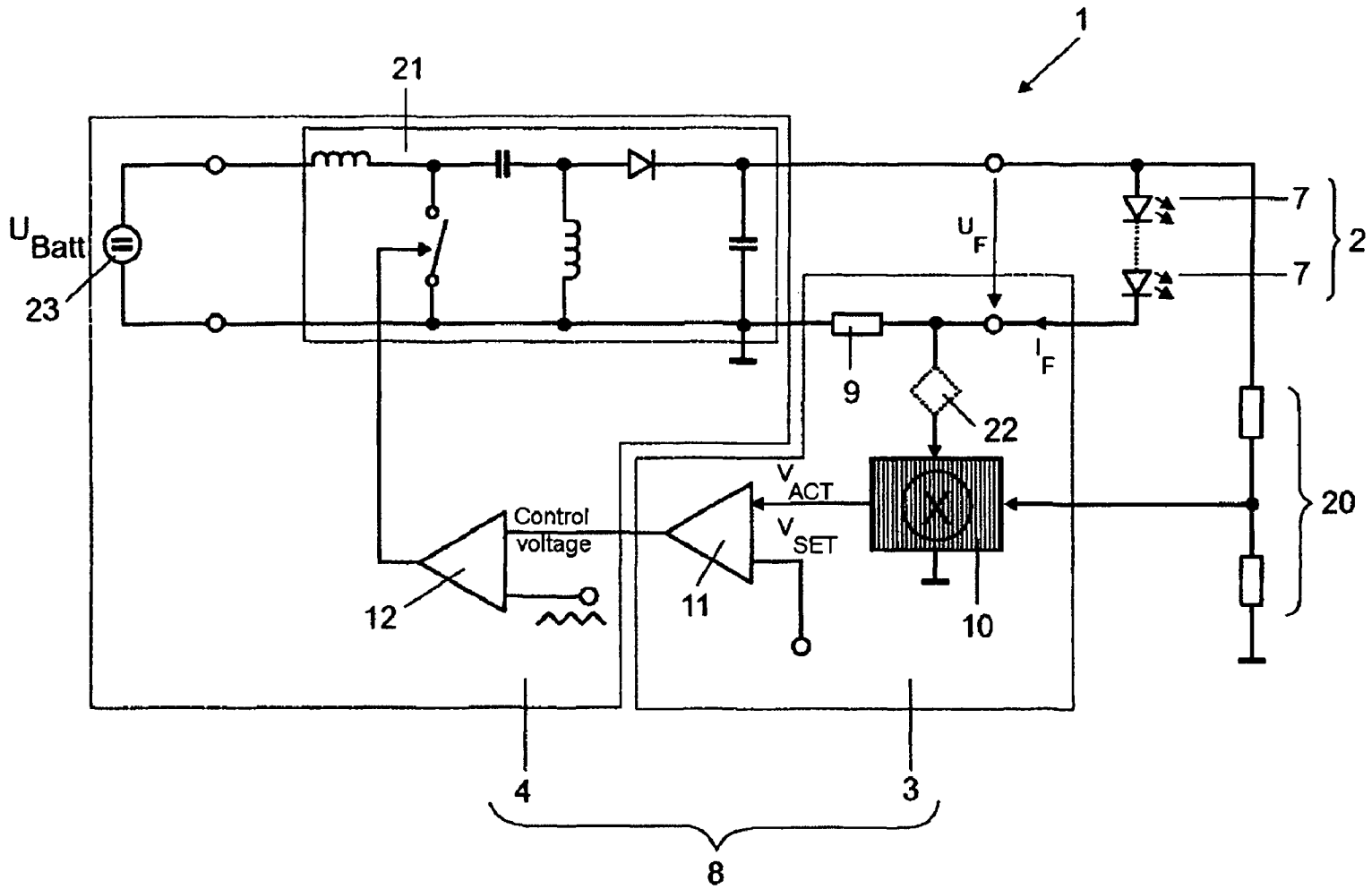
Figure 8:
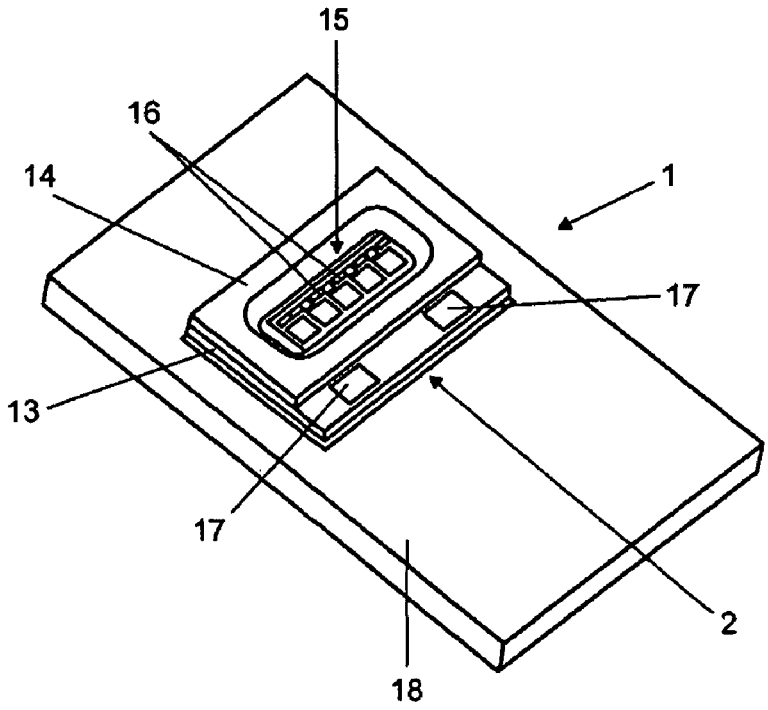
Figure 9:
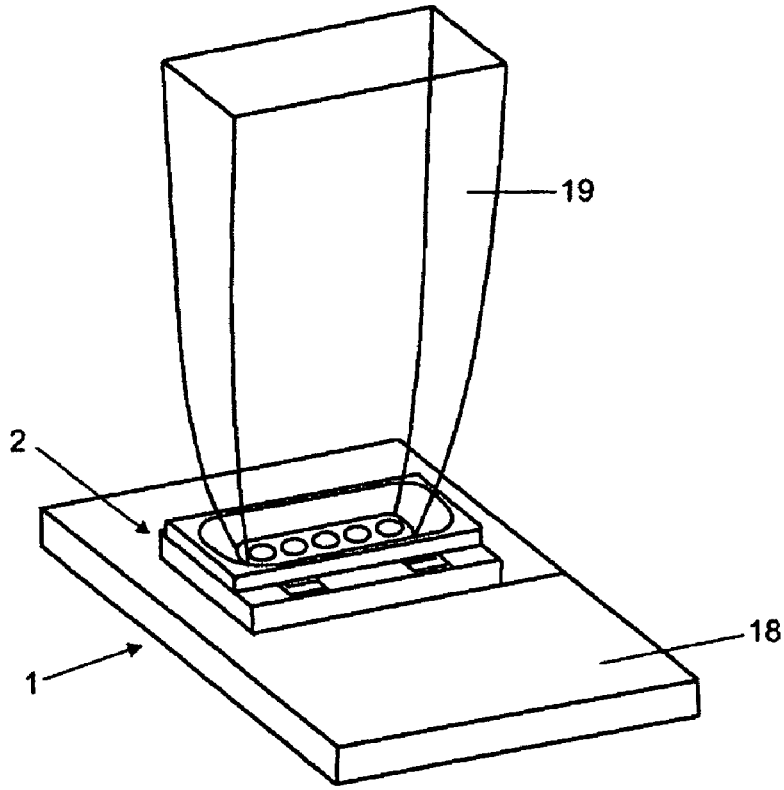

FIG. 1 shows a graph showing the time profile of the luminance and the temperature of a conventional cooled and uncooled light-emitting diode, FIG. 2 shows a block diagram of a conventional radiation source with a temperature sensor or a photosensor, FIGS. 3*a* and 3*b* show a graph showing the time profile of the luminance for conventional constant current regulation and inventive luminous flux regulation, FIG. 4 shows a graph showing the temperature-dependent profile of the forward voltage $U_f$, FIG. 5*a* shows a graph showing the forward voltage $U_f$, the forward current $I_f$ and the resultant converted power P, FIG. 5*b* shows a plurality of series-connected semiconductor bodies, FIG. 6 shows a graph showing a curve of constant radiation intensity which can be achieved using the inventive circuit unit or radiation source, FIG. 7 shows a block diagram of a first exemplary embodiment of a radiation source based on the invention, FIG. 8 shows a schematic illustration of a second exemplary embodiment of a radiation source based on the invention, and FIG. 9 shows a schematic illustration of the second exemplary embodiment of a radiation source which is connected to an optical element.

In the graph shown in FIG. 1, the luminance L[cd*m$^{-2}$] and the temperature T[° C.] are plotted over time t[sec]. The curves A and D show the time profile of the luminance L (curve A) and the temperature T (curve D) for a cooled light-emitting diode. By contrast, the curves C and B show the time profile of the luminance L (curve C) and the temperature T (curve B) for an uncooled light-emitting diode.

As can be seen from the curves, a steady state is achieved more quickly in the case of the cooled light-emitting diode than in the case of the uncooled light-emitting diode. In the steady state, the actual value corresponds to the setpoint value. In addition, the luminance L and the temperature T remain essentially unchanged in the steady state. It can be seen that the luminance L (curve C) drops by approximately 20% when the temperature T rises to approximately twice the initial value, as in the case of the uncooled light-emitting diode. It should be noted that a change in the temperature T can be caused both by the heat loss which occurs during operation of the light-emitting diode and by a change in the ambient temperature.

The drawback which results from the correlation between luminance L and temperate T, which is shown by means of the graph in FIG. 1, can be overcome in various ways.

FIG. 2 shows a block diagram of a conventional radiation source 1. In the first case, the radiation source 1 may have a photosensor 6 for ascertaining the luminance L produced by a radiation-emitting unit 2. The photosensor converts the received radiation into a photoelectric current which is output to an evaluation unit 3. The photoelectric current is used to set an appropriate actuation current for the radiation-emitting unit, so that the forward current $I_f$ provided by an actuation unit 4 is essentially constant. In the second case, the radiation source 1 may have a temperature sensor 5 for ascertaining the instantaneous temperature T of the radiation-emitting unit 2. A temperature table which assigns a suitable value for the actuation current to a temperature value can be used to set an appropriate actuation current.

In line with the invention, such additional components as a photosensor or temperature sensor can be saved. This is because advantageously a nonreactive resistor is suitable for keeping the luminous flux or the luminance L constant when there is a change in the temperature T. A further advantage is that there is no need to inspect sensors which are susceptible to soiling and failure.

In the case of a conventional radiation source (for example as in the case of the radiation source shown in FIG. 2), constant current regulation takes place, that is to say that the forward current $I_f$ is kept at a constant level. As shown by the curve B in FIG. 3*a*, the forward current $I_f$ does not change over time. Since the temperature T (curve C) increases, however, which in turn results in a decrease in the forward voltage $U_f$ (see FIG. 4, curve B), the luminance L (curve A) falls in the course of operation.

By contrast, the invention allows the luminance L of the emitted radiation to be kept constant during the operating period (see FIG. 3*b*, curve A). This can be achieved in line with the invention by means of luminous flux regulation of the radiation-producing semiconductor unit. In this case, the forward current $I_f$ is variable (curve B). In particular, the forward current $I_f$ is regulated such that as the temperature T of the radiation-producing semiconductor unit increases the luminance L remains essentially constant. As can be seen from FIG. 3*b*, this results in the forward current $I_f$ rising in the same way as the temperature T during initial operation.

The graph shown in FIG. 4 shows the aforementioned correlation between forward voltage $U_f$ and temperature T for a conventional radiation source with constant current regulation (curve A, forward current $I_f$=constant). As the temperature T rises, the forward voltage $U_f$ (curve B) falls, and vice versa. The gradient of the linear curve B is determined by a temperature coefficient $T_k$ which is dependent on materials used for the radiation-producing unit and on a possible heat-sink.

FIG. 5*a* shows the power P, which is a product of forward current $I_f$ and forward voltage $U_f$, for a conventional radiation source with constant current regulation. While the forward current $I_f$ is constant (straight line B), the forward voltage $U_f$ changes from a maximum value $U_{fmax}$ to a minimum value $U_{fmin}$ as the temperature increases (see FIG. 4). Accordingly, the power P changes from a maximum value $P_{max}$ to a minimum value $P_{min}$, which means that the following is true: $P_{max}>P_{opt}=P_{set}>P_{min}$. By contrast, in line with the invention the power P can be kept at an optimum value $P_{opt}$, which corresponds to the setpoint value $P_{set}$, in spite of increasing temperature (see FIG. 6).

At this point, it should be noted that in the case of a radiation-producing semiconductor unit 2 which, as FIG. 5*b* shows, has a plurality of series-connected, radiation-producing semiconductor bodies 7, the forward voltage $U_f$ corresponds to the phase voltage, that is to say the total voltage which drops in the forward direction from the first to the last semiconductor body 7.

FIG. 6 shows a curve A with constant radiation intensity or constant power $P_{opt}$. A curve of this kind can be attained using a radiation source according to the invention which has a circuit unit as explained in more detail below in connection with FIG. 7 and a radiation-producing unit as illustrated in FIG. 5*b*, for example. In contrast to the variable power values which are achieved with a conventional radiation source (see FIG. 5*a*), the radiation source according to the invention allows constant power values to be achieved by virtue of the forward current $I_f$ being matched to the decreasing forward voltage $U_f$ as the temperature T rises. In particular, the forward current $I_f$ is matched to the forward voltage $U_f$ such that the product of forward current $I_f$ and forward voltage $U_f$ assumes the optimum power value $P_{opt}$ or the setpoint value $P_{set}$ (in FIG. 6, $P_{opt}$ corresponds to the area of the rectangles shown).

FIG. 7 shows a block diagram of a radiation source 1 according to the invention. The radiation source 1 has a circuit unit 8 and the radiation-producing semiconductor unit 2, wherein the radiation-producing semiconductor unit 2 is electrically conductively connected to the circuit unit 8, so that the semiconductor unit 2 is supplied with electrical power by means of the circuit unit 8.

The circuit unit 8 has an evaluation unit 3 and an actuation unit 4, wherein the evaluation unit 3 comprises a nonreactive resistor 9. The voltage drop across the nonreactive resistor 9 can be used to determine the forward current $I_f$ on the basis of Ohm's Law. From this and using a voltage divider 20 it is also possible to determine the forward voltage $U_f$.

The nonreactive resistor 9 is connected in series with the radiation-producing semiconductor unit 2.

The ascertained values of the forward current $I_f$ and the forward voltage $U_f$ are forwarded to a mathematical circuit 10, which is part of the evaluation unit 3. The mathematical circuit 10 can be used to calculate an actual value $V_{act}$ which is a function f of the forward voltage $U_f$ and the forward current $I_f$, wherein one of the following correlations applies: $V_{act}=f(U_f*I_f)$; $V_{act}=f(U_f/I_f)$; $V_{act}=f(U_f+I_f)$; $V_{act}=f(U_f-I_f)$.

A first element 11, which is part of the evaluation unit 3, can be used to determine the difference between the actual value $V_{act}$ and the setpoint value $V_{set}$. Preferably, the element 11 is a subtractor which is used as a regulator. The first element 11 is used to produce a regulating voltage. This voltage is applied to a first input of a second element 12. A second input of the second element 12 has a delta voltage applied to it which is used to modulate the regulating voltage. Preferably, the element 12 is a comparator.

In the case illustrated, the forward current $I_f$ flowing through the radiation-producing semiconductor unit 2 is a direct current. Alternatively, the forward current $I_f$ may be a clocked current. The luminous flux can be kept constant by varying the direct current or changing the duty cycle of the PWM actuation.

As FIG. 7 shows, the actuation unit 4 has not only the second element 12 but also a voltage source 23, which provides a supply voltage $U_{Batt}$. The voltage source 23 may be a DC voltage source, such as a car battery. All of the other elements of the actuation unit 4 are a voltage converter 21 which, as in the present case, is a DC/DC converter, particularly a SEPIC converter.

PWM actuation requires an average forward current $I_f$ to be ascertained. To this end, the evaluation unit 3 may have an averaging element 22. Preferably the averaging element 22 is connected upstream of the mathematical circuit 10 in the forward direction.

By way of example, the averaging element 22 may be an RC low-pass filter.

FIG. 8 shows a radiation source 1 with a radiation-producing semiconductor unit 2, wherein the radiation-producing semiconductor unit 2 is arranged on a mounting support 18. The radiation-producing semiconductor unit 2 has a plurality of radiation-producing semiconductor bodies 7. These are arranged in a recess 15 in a housing body which is formed by means of a support 13 and a frame 14. Preferably, the semiconductor bodies 7 are electrically mounted in the housing body. To this end, the support 13 on which the semiconductor bodies 7 are arranged has contact areas. The contact areas are firstly wire connection pads 16 for making wire contact with the semiconductor bodies 7 at the top and secondly chip connection pads (not shown) for making contact with the semiconductor bodies 7 at the bottom, for example by means of soldering or conductive adhesive. The contact areas are electrically conductively connected to one of the outer contacts 17. The semiconductor bodies 7 may be connected in series, for example.

The mounting support 18 is provided firstly for mounting the radiation-producing semiconductor unit 2, and secondly the circuit unit (not shown) may be arranged on the mounting support 18. An electrically conductive connection between the circuit unit and the radiation-producing semiconductor unit 2 is then possible by means of the outer contacts 17. The mounting support 18 may also have a heatsink for cooling the radiation-producing semiconductor unit 2 or may be thermally conductively connected to a heatsink.

The apparatus shown in FIG. 9 has a radiation source 1, as already known from FIG. 8, and an optical element 19. By way of example, the optical element 19 is a nonimaging optical concentrator which can be used to reduce the divergence in the radiation emitted by the semiconductor unit 2.

The invention is not limited by the description with reference to the exemplary embodiments. Rather, the invention covers any new feature and any combination of features, which particularly includes any combination of features in the patent claims, even if this feature or this combination itself is not explicitly specified in the patent claims or exemplary embodiments.

The invention claimed is:

1. A circuit unit (8) for a radiation-producing semiconductor unit (2), wherein during operation a forward voltage $U_f$ is applied to the radiation-producing semiconductor unit (2) and the radiation-producing semiconductor unit (2) has a forward current $I_f$ flowing through it, wherein the circuit unit (8) regulates the forward current $I_f$ such that an actual value $V_{act}$, which is dependent on the forward current $I_f$ and the forward voltage $U_f$, assumes a prescribed setpoint value $V_{set}$ wherein the forward current $I_f$ is a clocked current; the circuit unit (8) has an actuation unit (4) and an evaluation unit (3); and wherein the evaluation unit (3) has an averaging element (2) for the purpose of ascertaining an average forward current $I_f$.

2. The circuit unit (8) as claimed in claim 1, wherein the evaluation unit (3) comprises a nonreactive resistor (9).

3. The circuit unit (8) as claimed in claim 2, wherein the forward current $I_f$ is ascertained using a voltage drop across the nonreactive resistor (9).

4. The circuit unit (8) as claimed in claim 2, wherein the nonreactive resistor (9) is connected in series with the radiation-producing semiconductor unit (2).

5. The circuit unit (8) as claimed in claim 1, wherein the evaluation unit (3) comprises a mathematical circuit (10).

6. The circuit unit (8) as claimed in claim 1, wherein the actual value $V_{act}$ is a function f of the forward voltage $U_f$ and the forward current $I_f$, wherein one of the following correlations applies: $V_{act}=f(U_f*I_f)$; $V_{act}=f(U_f/I_f)$; $V_{act}=f(U_f+I_f)$; $V_{act}=f(U_f-I_f)$.

7. The circuit unit (8) as claimed in claim 5 or 6, wherein the actual value $V_{act}$ is ascertained using the mathematical circuit (10).

8. The circuit unit (8) as claimed in claim 1, wherein the forward current $I_f$ is a direct current.

9. The circuit unit (8) as claimed in claim 1, wherein the evaluation unit (3) has at least one first element (11) for determining the difference between $V_{act}$ and $V_{set}$.

10. The circuit unit (8) as claimed in claim 9, wherein the first element (11) is a subtractor which is used as a regulator.

11. The circuit unit (8) as claimed in claim 1, wherein the actuation unit (4) is electrically conductively connected to the evaluation unit (3).

12. A radiation source (1) which has a circuit unit (8) as claimed in claim 1.

13. The radiation source (1) as claimed in claim 12, which has a radiation-producing semiconductor unit (2), wherein the radiation-producing unit (2) is electrically conductively connected to the circuit unit (8).

14. The radiation source (1) as claimed in claim 12 or 13, wherein the circuit unit (8) is used to regulate a luminous flux in the radiation-producing semiconductor unit (2).

15. The radiation source (1) as claimed in claim 13, wherein the radiation-producing semiconductor unit (2) has at least one radiation-producing semiconductor body (7).

16. The radiation source (1) as claimed in claim 15, wherein the radiation-producing semiconductor unit (2) has a series circuit comprising a plurality of semiconductor bodies (7).

17. The radiation source (1) as claimed in claim 12, wherein the radiation-producing semiconductor unit (2) contains at least one light-emitting diode or laser diode.

18. The radiation source (1) as claimed in claim 12, wherein the radiation source (1) is provided for the purpose of illumination.

19. The radiation source (1) as claimed in claim 12, wherein the radiation source (1) is provided for a headlight.

20. The radiation source (1) as claimed in claim 12, wherein the radiation source (1) is provided for the purpose of display backlighting.

21. A circuit unit (8) for a radiation-producing semiconductor unit (2), wherein during operation a forward voltage $U_f$ is applied to the radiation-producing semiconductor unit (2) and the radiation-producing semiconductor unit (2) has a forward current $I_f$ flowing through it, wherein the circuit unit (8) regulates the forward current $I_f$ such that an actual value $V_{act}$, which is dependent on the forward current $I_f$ and the forward voltage $U_f$, assumes a prescribed setpoint value $V_{set}$; wherein the circuit unit (8) has an actuation unit (4) and an evaluation unit (3) and, wherein the actuation unit (4) comprises a voltage converter (21).

22. The circuit unit (8) as claimed in claim 21, wherein the evaluation unit (3) comprises a nonreactive resistor (9).

23. The circuit unit (8) as claimed in claim 22, wherein the forward current $I_f$ is ascertained using a voltage drop across the nonreactive resistor (9).

24. The circuit unit (8) as claimed in claim 22, wherein the nonreactive resistor (9) is connected in series with the radiation-producing semiconductor unit (2).

25. The circuit unit (8) as claimed in claim 21, wherein the evaluation unit (3) comprises a mathematical circuit (10).

26. The circuit unit (8) as claimed in claim 21, wherein the actual value $V_{act}$ is a function f of the forward voltage $U_f$ and the forward current $I_f$, wherein one of the following correlations applies: $V_{act}=f(U_f*I_f)$; $V_{act}=f(U_f/I_f)$; $V_{act}=f(U_f+I_f)$; $V_{act}=f(U_f-I_f)$.

27. The circuit unit (8) as claimed in claim 25, wherein the actual value $V_{act}$ is ascertained using the mathematical circuit (10).

28. The circuit unit (8) as claimed in claim 21, wherein the forward current $I_f$ is a direct current.

29. The circuit unit (8) as claimed in claim 21, wherein the evaluation unit (3) has at least one first element (11) for determining the difference between $V_{act}$ and $V_{set}$.

30. The circuit unit (8) as claimed in claim 21, wherein the first element (11) is a subtractor which is used as a regulator.

31. The circuit unit (8) as claimed in claim 21, wherein the actuation unit (4) is electrically conductively connected to the evaluation unit (3).

* * * * *

UNITED STATES PATENT AND TRADEMARK OFFICE

CERTIFICATE OF CORRECTION

PATENT NO. : 8,044,607 B2
APPLICATION NO. : 12/227269
DATED : October 25, 2011
INVENTOR(S) : Alois Biebl et al.

It is certified that error appears in the above-identified patent and that said Letters Patent is hereby corrected as shown below:

Column 3, line 47:

Change "$AI_nGa_mIn_{1n-m}N$" to --$AI_nGa_mIn_{1-n-m}N$--.

Signed and Sealed this
Seventeenth Day of July, 2012

David J. Kappos

David J. Kappos
*Director of the United States Patent and Trademark Office*